US006176817B1

(12) United States Patent
Carey et al.

(10) Patent No.: US 6,176,817 B1
(45) Date of Patent: Jan. 23, 2001

(54) EXERCISE AND THERAPY DEVICE AND METHOD OF MAKING SAME

(76) Inventors: Anthony B. Carey, 3903 California St. #2, San Diego, CA (US) 92110; Olden Carr, 25665 Cross Creek Dr. #F, Yorba Linda, CA (US) 92887

( * ) Notice: Under 35 U.S.C. 154(b), the term of this patent shall be extended for 0 days.

(21) Appl. No.: 09/379,818

(22) Filed: Aug. 24, 1999

(51) Int. Cl.[7] ..... A63B 22/14
(52) U.S. Cl. ..... 482/146; 482/147
(58) Field of Search ..... 482/146, 147, 482/114, 118, 119, 65, 51, 71, 79, 72, 73, 130, 142

(56) References Cited

U.S. PATENT DOCUMENTS 3,306,626 * 2/1967 Kawada ..... 482/146
3,784,193 * 1/1974 Simjian ..... 482/146
4,193,592 * 3/1980 Bishow ..... 482/146
5,683,337 * 11/1997 Zetocha et al. ..... 482/146
5,879,276 * 3/1999 Miller ..... 482/146
5,941,807 * 8/1999 Cassidy et al. ..... 482/146

* cited by examiner

*Primary Examiner*—Jerome W. Donnelly
(74) *Attorney, Agent, or Firm*—Richard D. Clarke

(57) ABSTRACT

A new and improved exercise and therapy device and method of making same is provided. The present invention relates to a device which enables a selective therapeutic exercise regimen by providing a tensioning mechanism attached to a horizontally and vertically rotatable platform, provided with a safety hand rail to aid in maintaining balance and a vertical posture for the operator. The dish-shaped platform will react to changes in the operator's weight shifts and center of gravity placed upon it. When this novel multi-rotational aspect of the platform responds to subtle changes in the operator's center of gravity, movement of the dish-shaped platform will occur. These changes trigger muscular contractions around the joints of the operator responding to the rotation of the platform while the tensioning mechanism allows for selective resistance to the free movement of the platform enabling exercise and therapy routines for various muscle groups. Inexpensive manufacturing and maintenance costs will be associated with the production of this simple and effective design thus making the device readily accessible to more people.

20 Claims, 6 Drawing Sheets

EXERCISE AND THERAPY DEVICE AND METHOD OF MAKING SAME

BACKGROUND OF THE INVENTION

1. Field of the Invention

The present invention relates to a new and improved exercise and therapy device and method of using it. More particularly, the present invention relates to a device which enables a selective therapeutic exercise regimen by providing a selective tension controlling mechanism attached to a rotatable dish-shaped exercise and therapy platform that will react to the operator's shifting of weight.

2. Description of the Related Art

Today's modern occupations are primarily sedentary and non-physical in nature. Time constraints require more home or office based exercise devices and because of increased urbanization, space requirements for an exercise apparatus are often limited.

In addition, therapy of joint related injuries may require time consuming and expensive visits to facilities which maintain complex equipment for exercising and rehabilitation of various parts of the body.

The physical benefits of compact rotational exercise and therapy devices designed for individual use in the home or office are well known. Examples of different types and kinds of arrangements and techniques for utilizing exercise and therapy devices are disclosed in U.S. Pat. Nos. 5,879,276, 5,813,958, 5,683,337, 5,582,567 and 5,399,140.

In general, the structure and function of most rotational exercise and therapy devices involve platforms having either horizontal rotation about an axis or vertical rotation about an axis. A limited number of exercise and therapy devices provide some restricted and limited horizontal and vertical rotation. Some of the rotational exercise and therapy devices require motorization and others provide for adjustable resistance mechanisms.

Rotational exercise and therapy devices providing for limited horizontal and vertical rotation are known in the prior art. Such a device is described in U.S. Pat. No. 5,879,276. The operator causes movement through jumping and twisting movements. These jumping and twisting movements may exacerbate a pre-existing condition in joint injuries undergoing a therapeutic regimen on such a device.

Additionally, in order for the operator to benefit from continuous movement, the entire platform spins 360°. The spinning motion could result in disorientation of the operator and loss of balance critical to safe operation of a rotational exercise and therapy device. If used by the operator, the hand rail provided for safety in such a case would cause the operator to have to stop the rotation of the platform in one direction and cause it to move in the opposite direction through jumping and twisting movements, again unsuitable for certain joint injuries undergoing rehabilitative therapy.

There is no mechanism provided for this device which would allow for tension control of the rotating platform. Such tension control would provide for selective resistance applied to the platform and would be useful for exercising different muscle groups.

Therefore, it would be highly desirable to have a new and improved device and method for making same for rotational exercise and therapy which would allow continuous movement of a platform in horizontal and vertical rotation, which includes a safety hand rail, which would respond to slight changes in the operator's center of gravity, and which would also allow for selective resistance to free movement.

The device described in U.S. Pat. No. 5,813,958 addresses the problem of irritation of an existing injury due to jumping as described in the previous invention by providing a motorized platform supported on a universal joint which provides for limited horizontal and vertical rotation. This device provides for no adjustment or control by the operator during the exercise and limits the requirements of the body for spontaneous adjustments in balance and muscular contractions which are part of injury therapy and exercise.

In addition, the motorized mechanism and universal joint would make the device very expensive to own and operate. It would require skilled maintenance and would be unaffordable for many people requiring therapy and those wishing to have a versatile low cost exercise device.

Again, this device does nothing to address the problem of an adjustable tension mechanism for restricting free movement and selectively exercising certain muscle groups.

Therefore, it would be highly desirable to have a new and improved device and method for making same for rotational exercise and therapy which would be inexpensive to manufacture, respond to slight changes in the operator's center of gravity and which would also allow for selective resistance to free movement.

U.S. Pat. No. 5,683,337 describes a device that addresses the problem of tension control. However, the device has a platform that rotates horizontally and not vertically, so that the operator cannot achieve maximum therapy for selected joint musculature. In addition, the platform must be stopped in its rotation and started again in the opposite direction instead of requiring the operator to make spontaneous adjustments in balance and muscular contractions which are part of injury rehabilitation therapy and exercise. The device also lacks a safety hand rail to provide needed support for operators undergoing injury therapy. A safety hand rail makes further injury much less likely.

Therefore, it would be highly desirable to have a new and improved device and method for rotational exercise and therapy which would allow continuous movement of a platform in horizontal and vertical rotation in conjunction with a safety hand rail which would respond to slight changes in the operator's center of gravity.

U.S. Pat. No. 5,582,567 describes a device that has a platform that provides vertical rotation from side to side but does not provide for horizontal rotation. The device does provide safety hand rails. However, this inventive apparatus does not provide tension control.

Therefore, it would be highly desirable to have a new and improved device and method for making same for rotational exercise and therapy which would allow continuous movement of a platform in horizontal and vertical rotation, respond to slight changes in the operator's center of gravity, and allow for selective resistance to free movement.

Finally, U.S. Pat. No. 5,399,140 provides for a platform that does have limited vertical and horizontal rotation but has no tension control mechanism or support bars. In addition, the device is mechanically complicated with many parts which could require frequent repair or mandate numerous adjustments.

Therefore, it would be highly desirable to have a new and improved device and method for making same for rotational exercise and therapy which is inexpensive to manufacture and maintain, which includes a safety hand rail, and which would also allow for selective resistance to free movement when reacting to weight shifts by an operator undergoing exercise or rehabilitative therapy for an injury.

SUMMARY OF THE INVENTION

Therefore, the principal object of the present invention is to provide a new and improved device and method for making same, for rotational exercise and therapy which would allow continuous movement of a rotatable dish-shaped exercise and therapy platform in horizontal and vertical rotation. This continuous movement in a horizontal and vertical rotation provides a continuous change in the angle of joints at the ankles, subtarsal joints, knee joints and hip joints. Associated with changes in these joint angles will be muscular contractions around these joints for stability, balance and change of direction. Muscular involvement is also necessary for stabilization of the vertebral column, particularly the lumbar spine.

It is a further object of the present invention to provide such a new and improved device and method for making same, for rotational exercise and therapy, with a safety hand rail. The safety hand rail would aid in balance for those whose injuries or other medical conditions might cause the operator to lose balance during the performance of therapy and exercise routines. The primary purpose of the safety hand rail is to assist the operator in maintaining a vertical position of the pelvis, torso and head, as the lower extremity moves with the dish-shaped rotatable platform.

It is a further object of the present invention to provide such a new and improved device and method for making same, for rotational exercise and therapy, which would respond to slight changes in the operator's center of gravity. As the operator shifts weight while operating the novel exercise and therapy device, in order for the muscular contractions to occur, the mechano-receptors of the joints, the muscles and tendons must signal the muscular system to contract through the central nervous system. The inventive instant device reacts to these shifts in weight and center of gravity and allows for greatly improved exercise and therapy regimens.

It is yet a further object of the present invention to provide such a new and improved device and method for making same, for rotational exercise and therapy, which would also allow for selective resistance to free movement of the dish-shaped platform by providing a tensioning mechanism. Because of the varying degrees of difficulty that the device enables, there is a wide range of applications including but not limited to rehabilitation of ankle injuries, knee injuries and hip injuries which includes strengthening and proprioception, strengthening of lower back and hip muscles, balance training for the elderly, neuromuscular re-education for the lower extremity, sport specific training for snowboarding, surfing, skiing and other sports, and cardiovascular conditioning.

It is yet a further object of the present invention to provide such a new and improved device and method for making same, for rotational exercise and therapy, which would be inexpensive to manufacture and maintain. The design of the device provides a simple, yet effective means by which to provide rotational exercise and therapy without complex motorization or mechanization. Since the present invention lacks complex mechanisms and motorization and is considerably less expensive to manufacture, the initial cost to procure this device is relatively low, and repairs to the device are inexpensive and required much less frequently.

Briefly, the above and further objects of the present invention are realized by providing a new and improved exercise and therapy device and method of making it. More particularly, the present invention relates to a device which enables a selective therapeutic exercise regimen by providing a tensioning mechanism attached to a horizontally and vertically rotatable dish-shaped exercise and therapy platform, provided with a safety hand rail to aid in maintaining balance and a vertical posture for the operator. The rotatable dish-shaped exercise and therapy platform will react to changes in the operator's weight shifts and center of gravity placed upon it. When this novel multi-rotational aspect of the rotatable dish exercise and therapy platform responds to subtle changes in the operator's center of gravity, movement of the dish-shaped platform will occur. These changes trigger muscular contractions around the joints of the operator responding to the rotation of the platform while the tensioning mechanism allows for selective resistance to the free movement of the platform enabling exercise and therapy routines for various muscle groups.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein.

DESCRIPTION OF THE PREFERRED EMBODIMENTS

Figure 1:
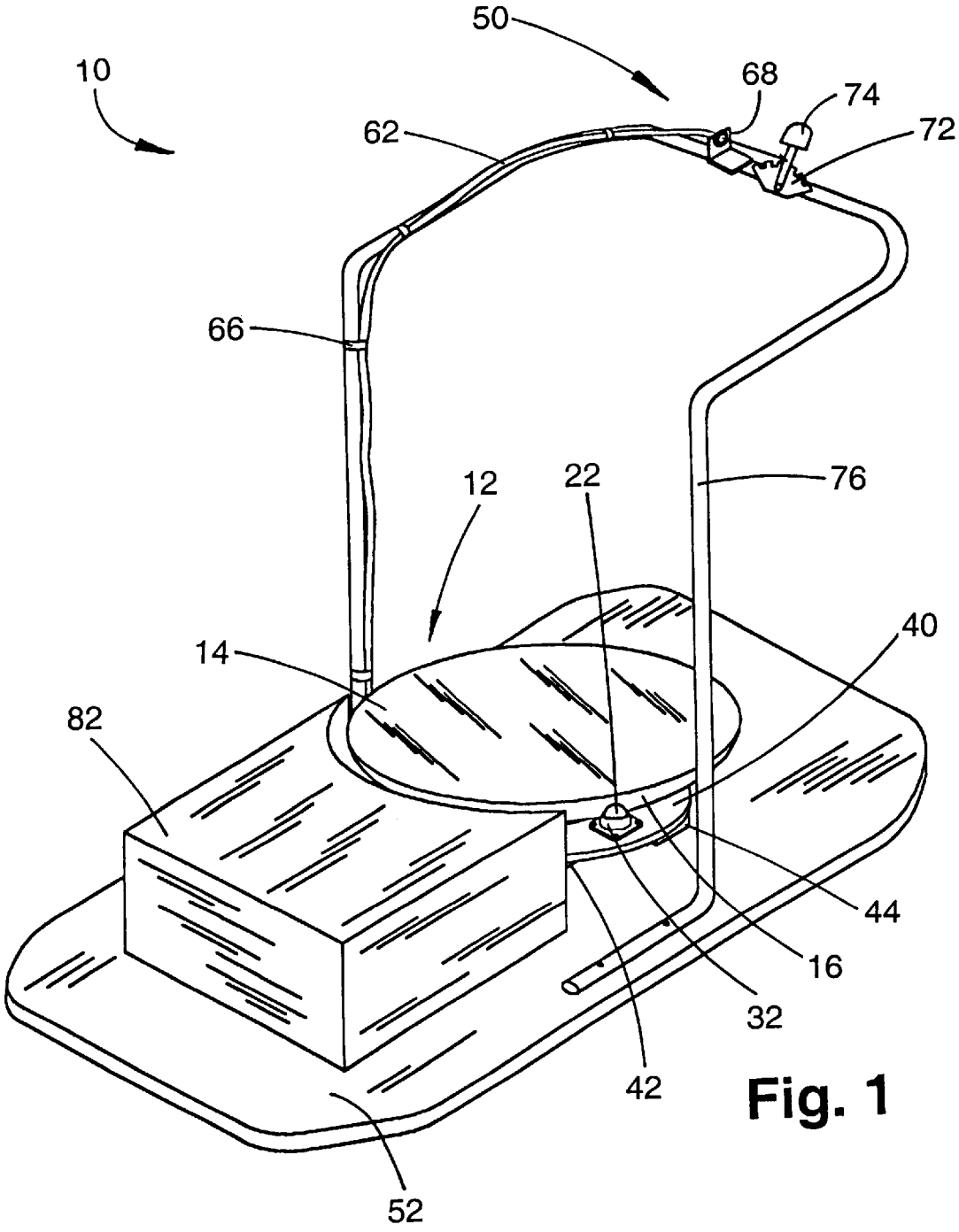
FIG. 1 is a perspective view of the novel exercise and therapy device constructed in accordance with the present invention.

Referring now to the drawings, and more particularly to FIG. 1 thereof, there is shown a new exercise and therapy device 10 which is constructed in accordance with the present invention. The new exercise and therapy device 10 is used to efficiently, effectively and economically provide exercise and therapy by providing selective exercise regimens to various muscle groups.

Referring to FIG. 1, the novel exercise and therapy device 10 is composed of four primary components. The first being the rotatable portion of the unit which includes the dish exercise and therapy platform 12 which has an upper flat surface 14 for receiving an operator and a lower curved surface 16 which is in frictional contact with a roller array or system, for example, a plurality of ball bearings, here only one of which is shown, ball bearing 22. Preferably three or more roller means or ball bearings are used to construct the device. The second component of the novel exercise and therapy device 10 is the ball bearing housing base support portion comprised of a plurality of ball bearing housings, only one of which is shown here, ball bearing housing 32. An equal number of ball bearing housings must be used, therefore preferably three or more. A bearing support frame 40, is supported by and held above the supportive base 52 by base support blocks, only two of which are shown (partially visible), base support blocks 42 and 44. The third component of the novel exercise and therapy device 10 is the tensioning mechanism 50 comprised of an upper coated tensioning cable 62, held close to a hand rail 76 by one or more cable retaining straps 66, an upper tensioning cable retaining bracket 68, notched tensioning adjustment mechanism 72, and tensioning adjustment mechanism handle 74. Other parts of the tensioning mechanism 50 are better illustrated in FIGS. 2 and 3 below.

The fourth component is the safety feature of the novel exercise and therapy device 10 is comprised of the hand rail 76, and the removable stationary step platform 82.

Figure 2:
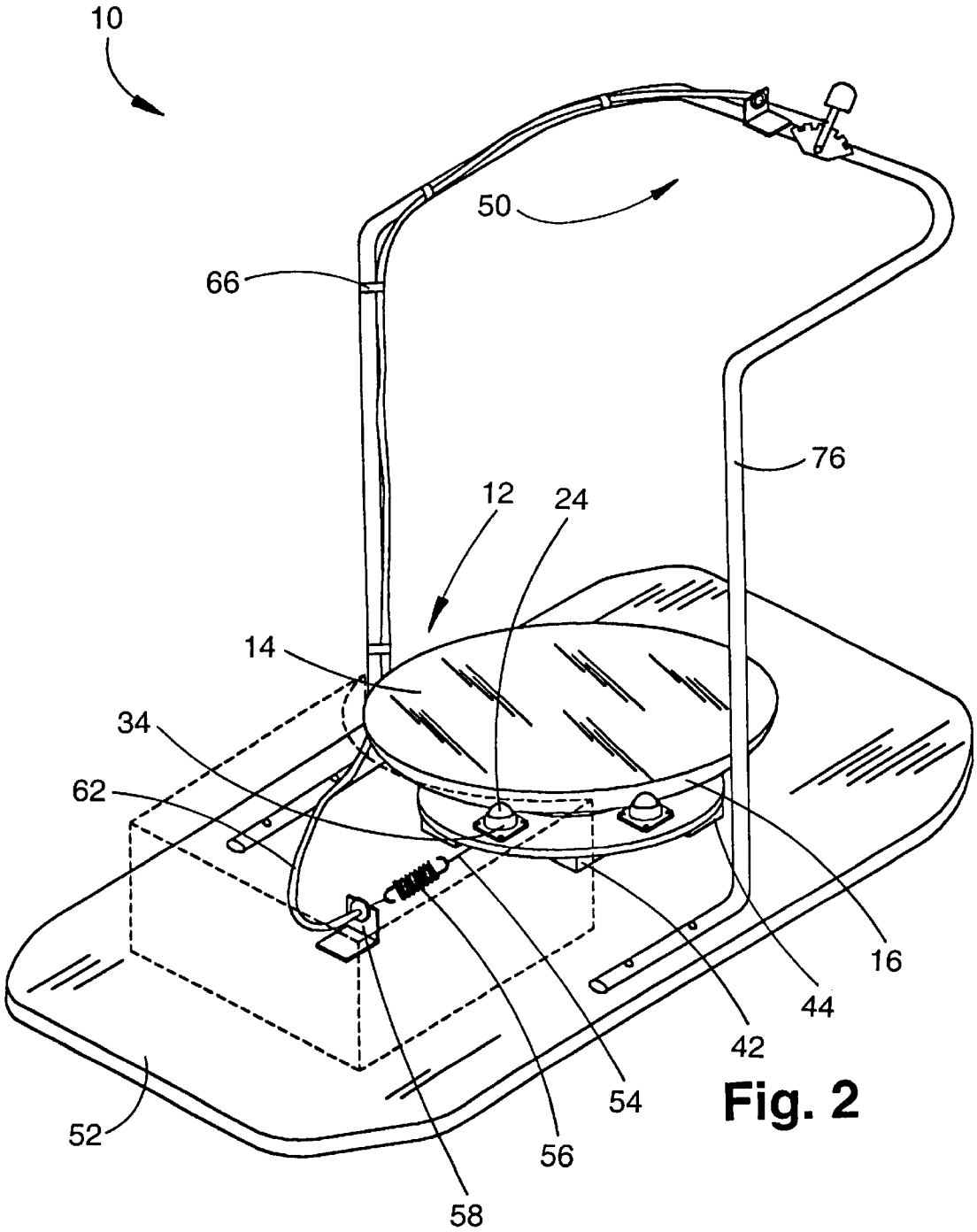
FIG. 2 is a perspective view of the novel exercise and therapy device according to the present invention, with the removable stationary step platform removed.

Turning now to FIG. 2 to illustrate the novel exercise and therapy device 10 and especially to show the tensioning mechanism 50 in greater detail, the removable stationary step 82, as shown in FIG. 1, has been removed. Now visible are a bare tensioning cable 54, tensioning spring 56, and lower tensioning cable retaining bracket 58. The upper coated tensioning cable 62 is directly attached to the lower bare tensioning cable 54 and tensioning spring 56 as its bare cable portion passes through the lower tensioning retaining bracket 58 (the plastic coating stops at the lower bracket 58). Also exposed by the removal of the stationary step platform 82, is another ball bearing housing 34 and associated ball bearing 24 in direct contact with the lower curved surface 16 of the rotatable dish-shaped platform 12.

Figure 3:
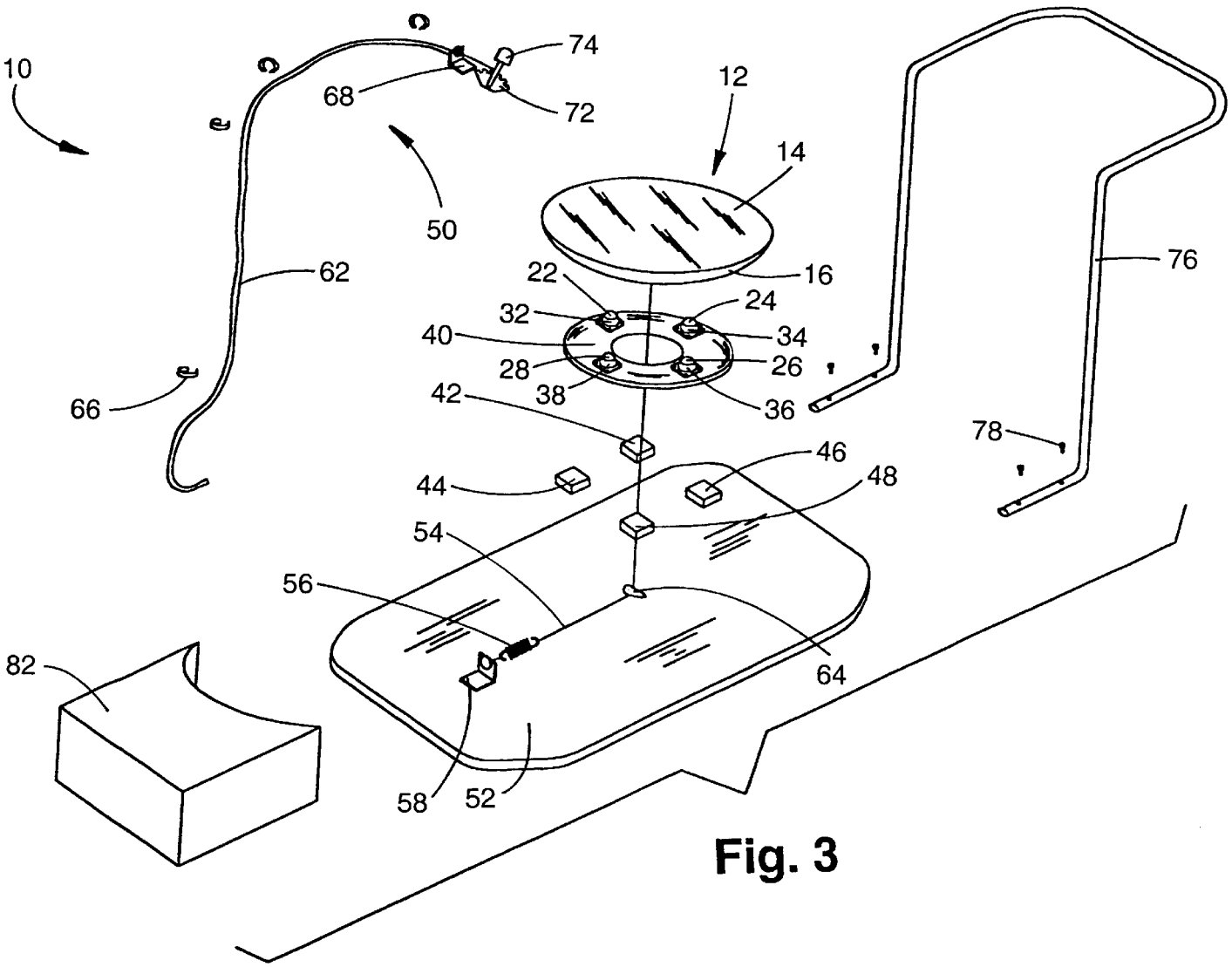
FIG. 3 is an exploded perspective view of an exercise and therapy device according to the present invention showing the separate elements of the device.

Referring now to FIG. 3, this exploded view of the novel exercise and therapy device 10 better illustrates all of the elemental parts of the four primary construction components. The first being the rotatable portion of the unit which includes the dish exercise and therapy platform 12 which has an upper flat surface 14 for receiving an operator and a lower curved surface 16 which is in frictional contact with a plurality of ball bearings 22, 24, 26 and 28 (spaced apart) preferably three or more. The second component of the novel exercise and therapy device 10 is the ball bearing housing base support portion comprised of a plurality of ball bearing housings 32, 34, 36 and 38 (spaced apart) preferably three or more, a bearing support frame 40, base support blocks 42, 44, 48 and 46 and a base 52. The third component of the novel exercise and therapy device 10 is the tensioning mechanism 50 comprised of a bare tensioning cable 54, tensioning spring 56, lower tensioning cable retaining bracket 58, coated tensioning cable 62, pulley 64, cable retaining straps 66, upper tensioning cable retaining bracket 68, notched tensioning adjustment mechanism 72, and tensioning adjustment mechanism handle 74. The fourth component is the safety feature of the novel exercise and therapy device 10 which is comprised of the hand rail 76, the handrail screws 78 for affixing the hand rail 76 to the supportive base 52, and the removable stationary step platform 82.

Considering now the novel exercise and therapy device 10 in greater detail with reference to FIG. 3, the components making up the rotatable portion of the exercise and therapy device 10 are simply and readily manufactured and assembled. The dish exercise and therapy platform 12 having a flat upper surface 14 to receive an operator. This flat upper surface 14 can be coated or roughened to enable better gripping and non-skid operation. The rotatable dish exercise and therapy platform 12 also has a lower curved surface 16 which is in frictional contact with a plurality of ball bearings 22, 24, 26 and 28 (spaced apart) preferably three or more.

The second primary component of the new exercise and therapy device 10 is the base support. The plurality of ball bearings 22, 24, 26 and 28 (spaced apart) preferably three or more are each housed within ball bearing housings 32, 34, 36 and 38 which are fixedly attached by a variety of means (including screws and adhesives) to the bearing support frame 40. The bearing support frame 40 is fixedly attached to a plurality of base support blocks 42, 44, 46, 48 preferably four or more in number which are permanently afixed to the base 52 by a variety of means (including screws and adhesives).

The third primary component of the new exercise and therapy device 10 is the unique tensioning mechanism 50. The distal end of the bare tensioning cable 54 is attached to the lower surface of the rotatable dish exercise and therapy platform 16 (explained in greater detail below, see FIGS. 7 and 8), and runs through a pulley 64 which is afixed to the base 52 of the new exercise and therapy device 10, but also the pulley 64 is allowed to swivel about its central axis. The proximal end of the bare tensioning cable 54 is attached to one end of a tensioning spring 56. The other end of the tensioning spring 56 is attached to the bare portion of a coated tensioning cable 62 by passing that bare portion of cable through the lower tensioning cable retaining bracket 58. The coated tensioning cable 62 is supported on the hand rail 76 by cable retaining straps 66 and the distal end of the coated tensioning cable 62 is attached to a notched tensioning adjustment mechanism 72 through an upper tensioning cable retaining bracket 68 which is attached to the middle of the upper portion of the safety hand rail 76. The tension on the coated tensioning cable 62 is adjusted by means of a tensioning adjustment mechanism handle 74. When the tensioning adjustment mechanism handle 74 is placed in the notch to the furthest away from the upper tensioning cable retaining bracket 68, the greatest amount of tension is placed upon the dish 12 at the distal end of the unique tensioning mechanism 50 and the rotatable dish exercise and therapy platform 12 is virtually set motionless at this setting allowing the operator to safely move onto and off of the removable stationary step platform 82 as well as onto and off of the rotatable exercise and therapy platform 12.

Figure 4:
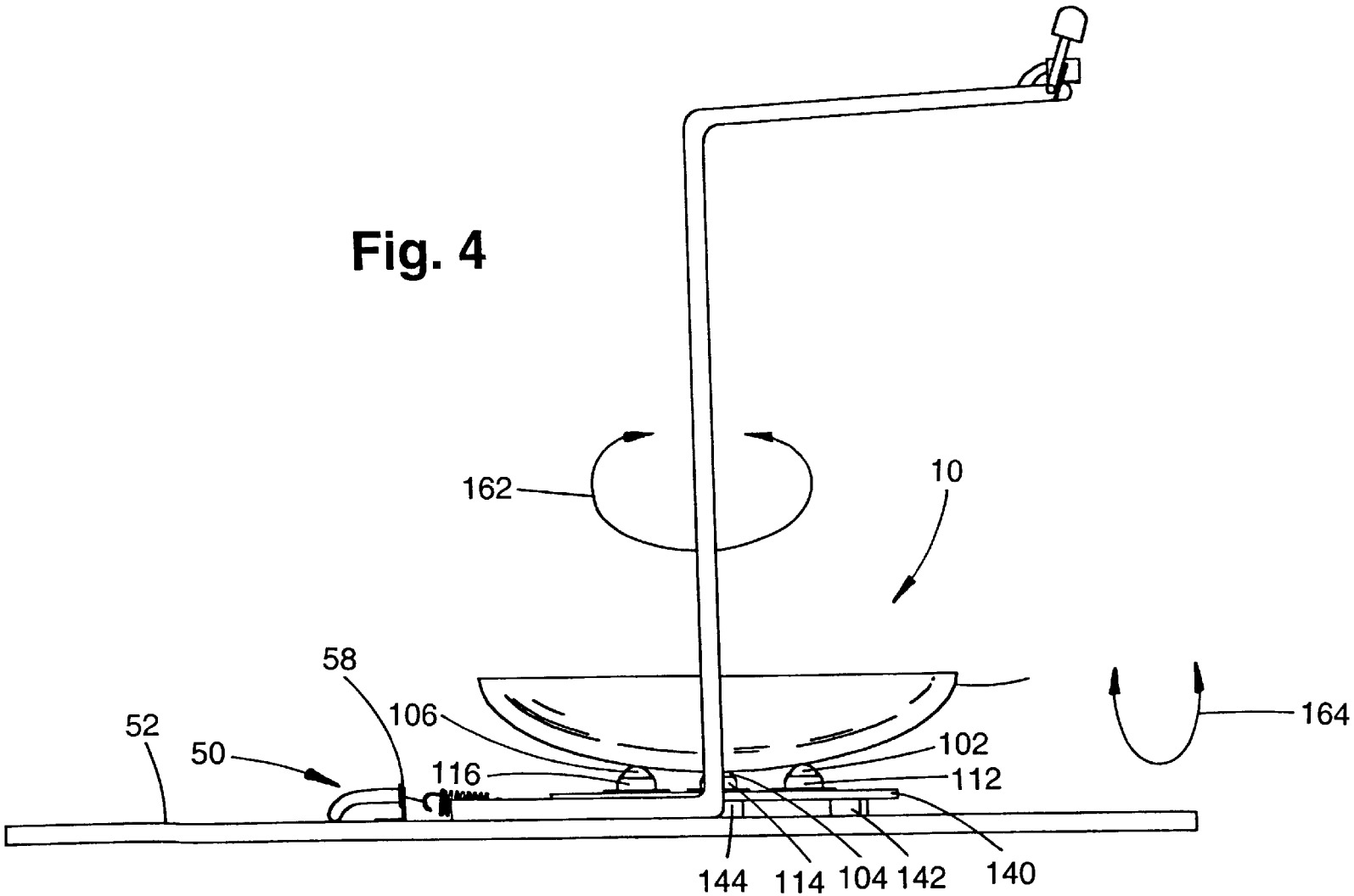
FIG. 4 is a side elevational view of the novel exercise and therapy device according to the present invention, with the removable stationary step platform removed.

Referring now to FIG. 4, a side view is illustrated and, as in FIG. 2 above, the removable stationary step platform is taken away to better show detail. Also, in this figure, an embodiment of the exercise and therapy device 10 having only three ball bearings within three ball bearing housings is shown, whereas all prior figures have shown four. Ball bearings 102, 104, and 106 are set within ball bearing housings 112, 114, and 116. These are fixedly attached to the ball bearing housing support frame 140 which in turn is set upon supportive base 52 using three or more support blocks, here only base support blocks 142 and 144 are shown. These base support blocks 142 and 144 hold the bearing support frame 140 above the upper flat surface of the supportive base 52. The bearing support frame 140 being elevated in this way, enables the bare lower tensioning cable (not shown) to be attached to the lower curved surface 16 of the exercise and therapy dish platform 12, and run over to the lower tensioning cable retaining bracket 58 in an unobstructed fashion. This is essential to the proper functioning of the tensioning mechanism 50.

Figure 6:
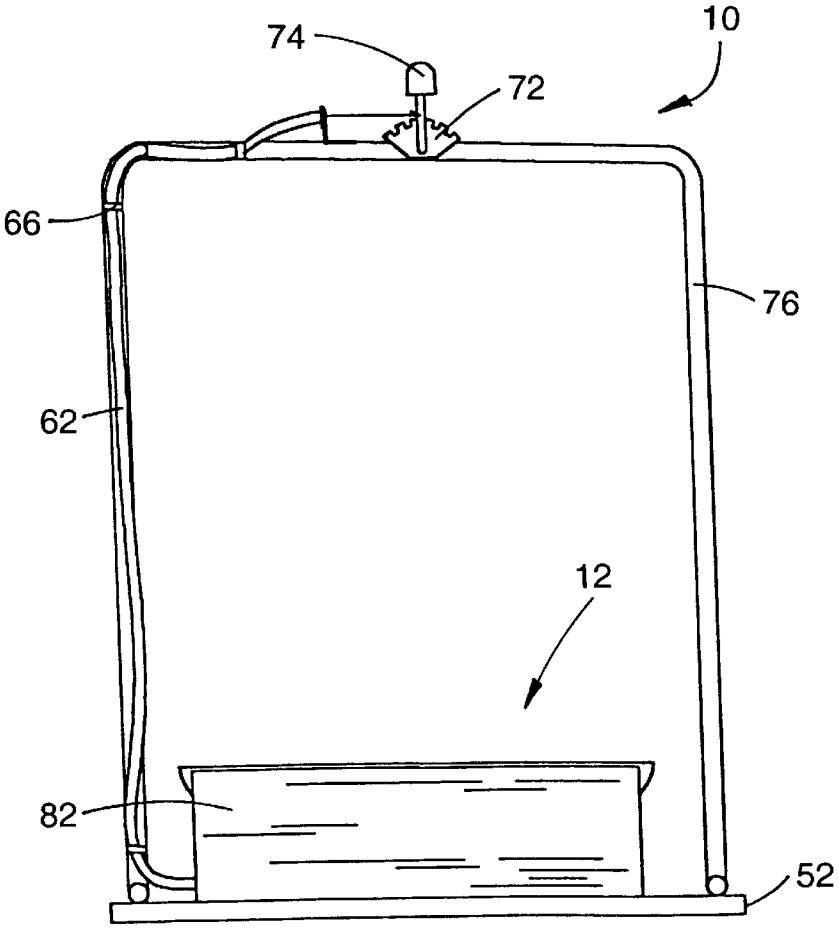
FIG. 6 is a front elevational view of the novel exercise and therapy device according to the present invention, with the removable stationary step platform in place.
Figure 5:
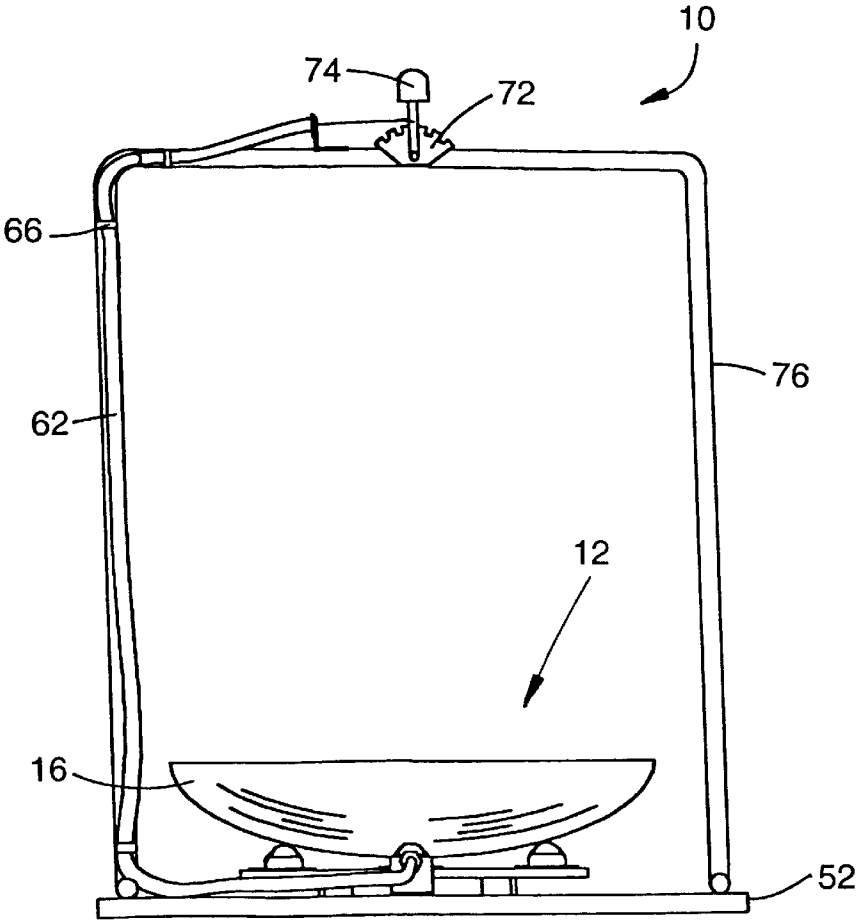
FIG. 5 is a front elevational view of the novel exercise and therapy device according to the present invention.

Referring now to FIG. 5 and FIG. 6, the fourth primary component of the novel exercise and therapy device 10 is the safety feature which includes the safety hand rail 76 which is afixed to the base 52 by means of the hand rail screws 78 (not shown, but see FIG. 3). Other suitable means may also be used for affixing the hand rail 76 to the base 52. The safety hand rail 76 provides a means by which the operator may maintain balance during the process of moving from the removable stationary step platform 82 to the rotatable dish and therapy platform 12 and during the exercise and therapy regimen which begins after the tensioning adjustment mechanism handle 74 is adjusted to the desired tension setting. The safety hand rail 76 also serves to support the coated tensioning cable 62 which is attached to the hand rail 76 by a plurality of cable retaining straps 66. It is also contemplated that another embodiment of the exercise and therapy device, as described herein, may have the tensioning cable run inside of the hand rail, in which case the safety hand rail would be constructed of rigid hollow tubing. In this way, the tensioning cable would be out of sight, and out of the way of the operator.

The safety hand rail 76 further serves the purpose of providing a base for mounting the notched tensioning adjustment mechanism 72 and the tensioning adjustment mechanism handle 74 in such a position as to provide convenient accessibility to the operator during use of the exercise and therapy device 10.

Another element of safety is provided by use of the removable stationary step platform 82, here shown in place on the apparatus in FIG. 6 and removed to show greater detail in FIG. 5. Having a firm stationary platform 82 to mount and dismount from the rotatable dish exercise and therapy platform 12 is essential to safety as the movable platform 12 may be in a low tension configuration and cause the operator to stumble or fall upon mounting. By using the stationary step platform 82 and the hand rail 76 together to balance and brace the operator, the chance of a sudden loss of balance is nearly entirely eliminated during use of the exercise and therapy device 10. In this way the safety elements of the novel device work together to insure accident free use.

Figure 7:
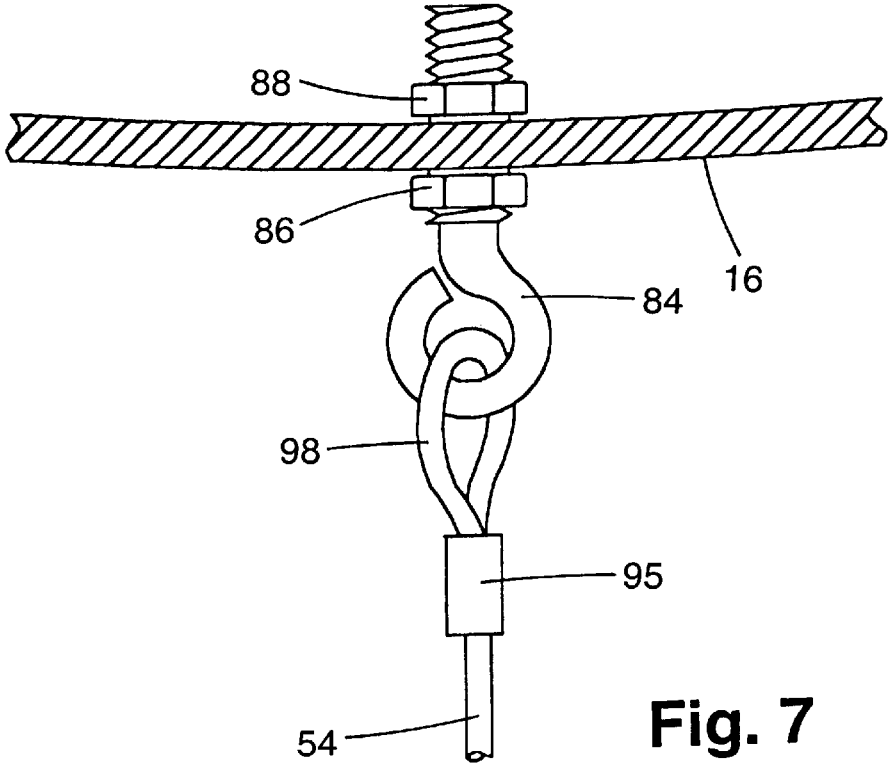
FIG. 7 is a close up side elevational view of one embodiment of the lower tensioning cable attachment to the bottom of the lower curved surface of the rotatable dish exercise and therapy platform, according to the present invention.

Referring now to FIG. 7, one embodiment of the means by which the bare lower tensioning cable 54 is attached to the lower curved surface of the rotatable dish exercise and therapy platform 16 is shown in detail. The threaded eye hook 84 is secured to the lower curved surface of the rotatable dish exercise and therapy platform 16 by means of an internal mounting nut 86 and an external mounting nut 88. The eye hook then receives the looped end 98 of the bare tensioning cable 54. The loop is secured by means of a cable crimp 95.

Figure 8:
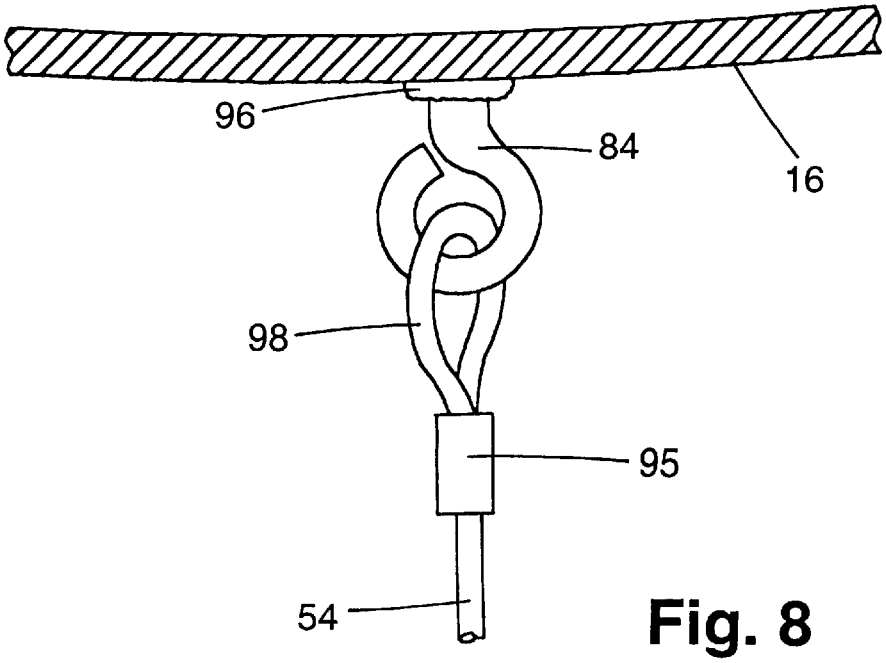
FIG. 8 is a close up side elevational view of another embodiment of the lower tensioning cable attachment to the bottom of the lower curved surface of the rotatable dish exercise and therapy platform according to the present invention.

Turning now to FIG. 8, this figure illustrates another means of attachment for the bare tensioning cable 54 to the lower curved surface of the rotatable dish exercise and therapy platform 16 in detail. The eye hook 94 is attached by a welded or soldered connection 96 to the lower curved surface of the rotatable dish exercise and therapy platform 16, and receives the distal end of the bare tensioning cable 54 forming a loop 98 secured by a cable crimp 95.

When in use for exercise or therapy regimen, the novel exercise and therapy device 10 is placed on a floor, deck or other suitable flat surface. The operator steps upon the removable stationary step platform 82, adjusts the tensioning adjustment mechanism handle 74 to maximum tension and steps upon the flat surface of the rotatable dish exercise and therapy platform 12. At this setting, the lower curved surface of the rotatable dish exercise and therapy platform 16 frictionally engages the plurality of ball bearings 22, 24, 26 and 28 as the tensioning mechanism places the greatest torque upon the rotatable dish exercise and therapy platform 12. When the tensioning mechanism is adjusted by the operator by moving the tensioning adjustment mechanism handle 74 toward the left side of the notched tensioning adjustment mechanism 72, the friction is reduced and the operator's shifting center of gravity moves the rotatable dish exercise and therapy platform 12 with less force applied, about a vertical axis of rotation 162 and a horizontal axis of rotation 164 (as shown in FIG. 4). The adjustment of amount of tension on the rotatable dish exercise than therapy platform 12 determines the amount of force exerted by the operator required to cause rotation of the rotatable dish exercise and therapy platform 12 and allows the operator to exercise a variety of muscle groups at differing exertion levels. Additionally, adjustment of the tensioning mechanism 50 can be used to compensate for differing individuals total body weight, thereby creating optimal conditions for a productive exercise workout session or therapy session for that particular individual.

Finally, the novel exercise and therapy device 10 can be configured to utilize three or more ball bearings such as the four ball bearings shown in FIG. 3, ball bearings 22, 24, 26 and 28 to allow for greater or lesser surface area contact between the lower surface of the rotatable dish exercise and therapy platform 16 thus allowing for greater or less frictional contact. The greater the frictional contact, the greater the amount of force required to cause rotation when the tensioning mechanism is activated. FIG. 4 is an example of another embodiment of the novel exercise and therapy device 10 that utilizes three ball bearings. Not just ball bearings can be employed for this purpose, as other roller-type mechanisms are also contemplated.

It should be understood, however, that even though these numerous characteristics and advantages of the invention have been set forth in the foregoing description, together with details of the structure and function of the invention, the disclosure is illustrative only, and changes may be made in detail, especially in matters of shape, size, chemistry and arrangement of parts within the principal of the invention to the full extent indicated by the broad general meaning of the terms in which the appended claims are expressed.

What is claimed is:

1. An exercise and therapy device comprising:

(a) a supportive base having an upper flat surface;

(b) three or more ball bearings movably held within three or more bearing housings;

(c) a bearing support base including three or more base support blocks fixedly attached to said supportive base and said ball bearing housings such that said bearing support is held in place above the flat surface of said supportive base;

(d) circular dish-shaped platform means having a flat upper surface and a curved lower surface, said curved lower surface in contact with said ball bearings whereby said circular platform means is rotatably placed upon said ball bearings, and whereby said platform means is readily moved in the horizontal and vertical directions when any force is exerted upon said flat upper surface of said circular platform means.

2. The exercise and therapy device according to claim 1, including tensioning means attached to said curved lower surface of said circular platform means for the purpose of applying resistance to the free movement of said circular platform means in order to require greater or lesser force to be exerted for movement of said circular dish-shaped platform means in the horizontal and vertical directions.

3. The exercise and therapy device according to claim 2, wherein said tensioning means is fixedly attached to the center portion of said curved lower surface of said dish-shaped circular platform means.

4. The exercise and therapy device according to claim 3, wherein said tensioning means includes an upper cable, a lower cable, pulley means, spring means, and a tension adjusting means, for the purpose of controlling the application of resistance to free movement of said dish-shaped circular platform.

5. The exercise and therapy device according to claim 4, wherein said tension adjusting means includes a notched tensioning adjustment positioning mechanism and a handle fixedly attached to said upper cable, whereby said handle is selectively moved to various notch positions within said notched tensioning adjustment positioning mechanism for the purpose of causing greater or lesser tension on said upper cable, said spring means and said lower cable, and thereby varying the resistance to movement of said dish-shaped circular platform means.

6. The exercise and therapy device according to claim 4, wherein said tension adjustment means further includes said lower cable attached to said lower curved surface of said circular platform means, said lower cable threaded through said pulley means swivelingly attached to said upper surface of said supportive base, said lower cable fixedly attached to said spring means, and said spring means fixedly attached to a spring bracket means.

7. The exercise and therapy device according to claim 6, wherein said upper cable is fixedly attached to said spring bracket means and said tensioning adjustment means and passes through an upper bracket means.

8. The exercise and therapy device according to claim 7, further including a safety hand rail means and wherein said upper cable is coated with a protective plastic coating and is attached to said safety hand rail means.

9. The exercise and therapy device according to claim 1, including safety hand rail support means to aid in balance and control of an operator engaged in an exercise or therapy regimen while operating said device.

10. The exercise and therapy device according to claim 8, wherein said tensioning adjustment means is securely mounted on said safety hand rail means, such that an operator can readily manipulate said tensioning adjustment means and thereby selectively and variably apply differing resistance to said circular dish-shaped platform means.

11. The exercise and therapy device according to claim 10, wherein said safety hand rail is comprised of a curved rigid tube fixedly attached to said supportive base, whereby said upper cable runs within said curved rigid tube.

12. The exercise and therapy device according to claim 1, wherein a removable stationary step platform is included to aid the operator in mounting and dismounting from said rotatable circular platform means.

13. A method of manufacturing an exercise and therapy device comprising the steps:

(a) providing a supportive base having an upper flat surface;

(b) attaching a roller mechanism support frame to said supportive base;

(c) providing a roller mechanism comprising three or more ball bearings movably held within three or more ball bearing housings attached to said roller mechanism support frame;

(d) providing a circular dish shaped platform having a flat upper surface and a curved lower surface said lower surface in contact with said roller mechanism ball bearings whereby said dish-shaped platform is free to variably move in a horizontal and vertical direction;

(e) providing a tensioning mechanism attached to said roller mechanism and said platform wherein said tensioning mechanism includes a cable attached to said curved lower surface of said circular platform means for the purpose of applying resistance to the free movement of said circular platform means whereby resistance to free movement is variably applied to said roller mechanism and dish-shaped platform such that movement of said dish shaped platform in the horizontal and vertical directions requires greater force be applied.

14. The method according to claim 13, which further includes the step of providing a safety hand rail.

15. The method according to claim 13, which further includes the step of providing a removable stationary platform.

16. The method according to claim 13, wherein said roller mechanism includes freely rotating ball bearings housed within ball bearing housings.

17. The method according to claim 13, wherein said tensioning mechanism includes a cable having a distal end attached to the bottom center portion of said dish-shaped platform and a proximal end attached to a handle adjusting member.

18. The method according to claim 14, wherein said tensioning mechanism includes a cable having a distal end attached to the bottom center portion of said dish-shaped platform and a proximal end attached to a handle adjusting member.

19. The method according to claim 18, wherein said handle adjusting member is mounted on said safety hand rail, whereby an operator of said tensioning mechanism can readily manipulate said handle adjusting member to alter the tension in said cable and thereby variably select the resistance to the free movement of said dish-shaped platform.

20. A method for using the exercise and therapy device of claim 14, wherein an operator of said device mounts said device and shifts their center of gravity in twisting and rocking motions thereby improving the operator's balance, strength, proprioception, range of motion, neuromuscular control, flexibility, and kinesthetic awareness of the muscles of, and joints of, the lower extremities, pelvis, lumbar spine and torso, while at the same time realizing cardiovascular benefits and further wherein said operator manually adjusts said tensioning mechanism to vary resistance to free movement of said circular platform means such that more or less energy is expended by said operator during an exercise or therapy session using said device.

* * * * *